US007208672B2

(12) United States Patent
Camiel

(10) Patent No.: US 7,208,672 B2
(45) Date of Patent: Apr. 24, 2007

(54) SYSTEM AND METHOD FOR STRUCTURING AND MIXING AUDIO TRACKS

(76) Inventor: Noam Camiel, 47 Bilu St. Apt 4, Tel-Aviv 64256 (IL)

( * ) Notice: Subject to any disclaimer, the term of this patent is extended or adjusted under 35 U.S.C. 154(b) by 92 days.

(21) Appl. No.: 10/779,692

(22) Filed: Feb. 18, 2004

(65) Prior Publication Data

US 2004/0159221 A1 Aug. 19, 2004

Related U.S. Application Data

(60) Provisional application No. 60/447,696, filed on Feb. 19, 2003.

(51) Int. Cl.
*G10H 1/08* (2006.01)
*G10H 7/00* (2006.01)

(52) U.S. Cl. ..... 84/625; 84/612; 84/636; 84/660; 700/94; 381/119; 381/56; 348/584

(58) Field of Classification Search ..... 84/660, 84/625, 615, 601, 602; 700/94; 381/119
See application file for complete search history.

(56) References Cited

U.S. PATENT DOCUMENTS

| | | | | |
|---|---|---|---|---|
| 6,175,632 | B1 * | 1/2001 | Marx | 381/56 |
| 6,316,712 | B1 * | 11/2001 | Laroche | 84/636 |
| 6,686,970 | B1 * | 2/2004 | Windle | 348/584 |
| 2002/0091455 | A1 * | 7/2002 | Williams | 700/94 |
| 2002/0166440 | A1 * | 11/2002 | Herberger et al. | 84/625 |
| 2004/0177746 | A1 * | 9/2004 | Becker | 84/612 |
| 2005/0025320 | A1 * | 2/2005 | Barry | 381/119 |

* cited by examiner

*Primary Examiner*—Lincoln Donovan
*Assistant Examiner*—Christina Russell

(57) ABSTRACT

A system for creating a variation of an audio track from audio building blocks is presented, where track variation may be created during a live performance. Two or more of the presented systems may be coupled to automatically maintain a beat mix between two or more playing audio track building blocks. Audio building blocks are prepared in advance to include features that may enable the creation of the track variation and the automatic maintaining of the beat mix.

22 Claims, 12 Drawing Sheets

| | | | |
|---|---|---|---|
| **CD_Serial_Number** | | 123232323 | |
| **Track Number** | | 1 | |
| **Track Name** | | Disco Queen | |
| **Artist** | | 7 Monarcs | |
| **Segment Number** | **Start Time** | **End Time** | **Number Of Beats** |
| Segment 1 | 0:0:933 | 0:2:767 | 4 |
| Segment 2 | 0:2:767 | 0:4:605 | 4 |
| Segment 3 | 0:4:605 | 0:6:439 | 4 |
| Segment 4 | 0:6:439 | 0:11:941 | 12 |
| Segment 5 | 0:11:941 | 0:13:775 | 4 |
| Segment 6 | 0:13:775 | 0:15:609 | 4 |
| Segment 7 | 0:15:609 | 0:22:945 | 16 |
| Segment 8 | 0:22:945 | 0:37:620 | 32 |
| Segment 9 | 0:37:620 | 0:41:288 | 8 |
| Segment 10 | 0:41:288 | 1:06:964 | 28 |
| Segment 11 | 1:06:964 | 1:10:632 | 8 |
| Segment 12 | 1:10:632 | 1:25:304 | 32 |
| Segment 13 | 1:25:304 | 1:54:648 | 64 |
| Segment 14 | 1:54:648 | 1:56:482 | 4 |
| Segment 15 | 1:56:482 | 1:58:316 | 4 |
| Segment 16 | 1:58:316 | 2:11:154 | 28 |
| Segment 17 | 2:11:154 | 2:14:822 | 8 |
| Segment 18 | 2:12.988 | 2:14:822 | 4 |
| Segment 19 | 2:14:822 | 2:18:490 | 8 |
| Segment 20 | 2:18:490 | 2:33:162 | 32 |
| Segment 21 | 2:33:162 | 2:36:830 | 8 |
| Segment 22 | 2:36:830 | 2:40:498 | 8 |
| Segment 23 | 2:40:498 | 3:09:842 | 64 |
| Segment 24 | 3:09:842 | 3:13:510 | 8 |
| Segment 25 | 3:13:510 | 3:17:178 | 8 |
| Segment 26 | 3:17:178 | 3:19:012 | 4 |
| Segment 27 | 3:19:012 | 3:33:684 | 32 |
| Segment 28 | 3:33:684 | 3:35:518 | 4 |
| Segment 29 | 3:35:518 | 4:04:862 | 64 |

Figure 4D

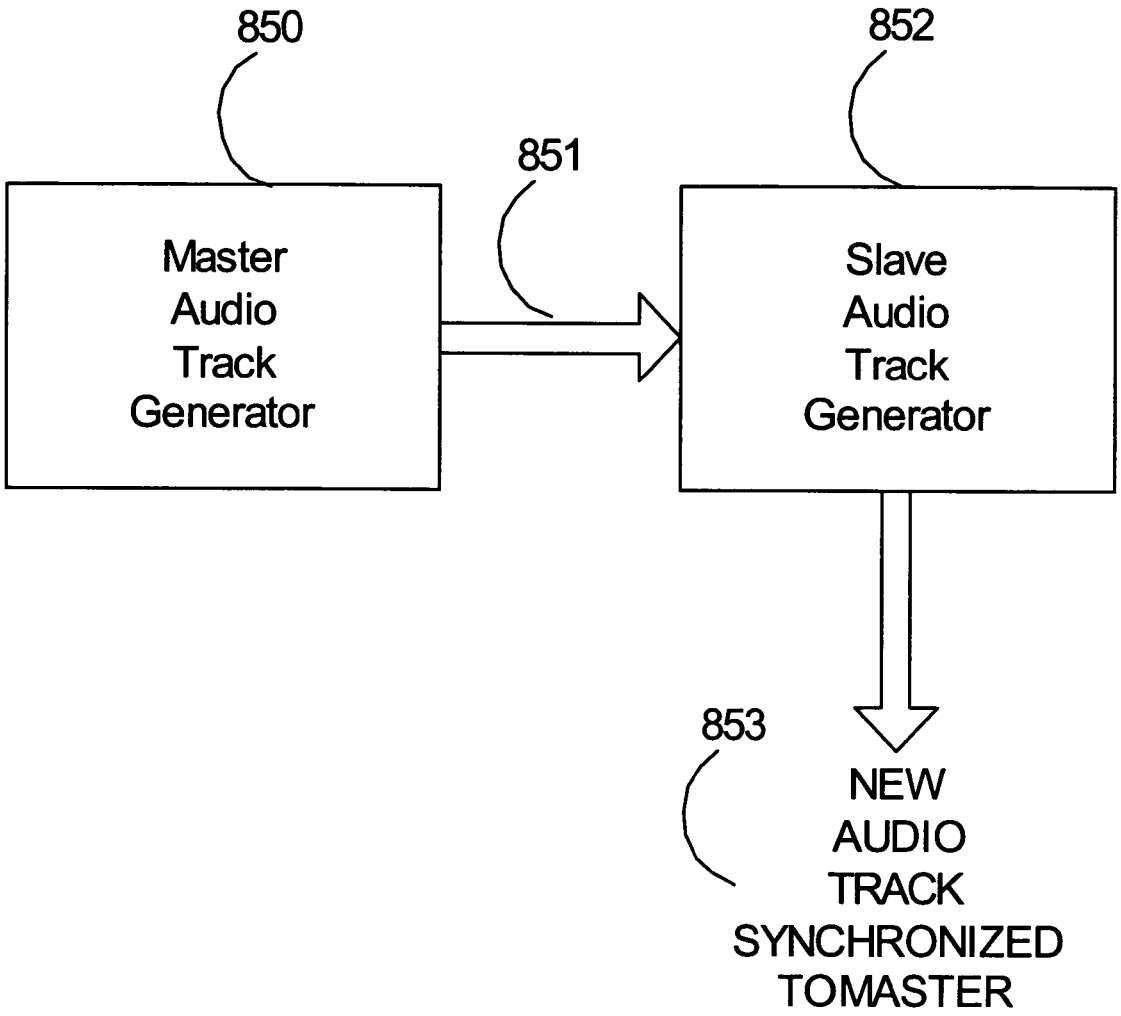
Figure 8-I

SYSTEM AND METHOD FOR STRUCTURING AND MIXING AUDIO TRACKS

CROSS-REFERENCE TO RELATED APPLICATIONS

This application claims the benefit of U.S. Provisional Patent Ser. No. 60/447,696, filed Feb. 19, 2003 by the present inventor.

FIELD OF INVENTION

This invention generally relates to audio playback.

BACKGROUND OF THE INVENTION

A person playing prerecorded music for people to enjoy, for example in clubs and discotheques will be referred herein as a Disc Jockey or DJ.

The following terms regarding music are defined:

Rhythm of music is the organization of an audio track in relation to time.

A beat is the basic unit of duration in an audio track.

A measure is a notation of a longer pattern than a beat within the track. The duration of one measure is usually equal to some fixed number of beats.

The time signature, written similarly to a fraction, sets the rhythmic context, called meter. The numerator tells the duration of a measure, in beats (common are 2,3,4,6) while the denominator tells the length of one beat in the measure.

Tempo describes how fast the rhythm is played, or how the beats correspond to absolute temporal durations. Tempo can be specified by beat frequency, beats per minute, hereafter BPM. Since there are 60 seconds per minute, BPM/60 equals HZ (cycles per second). The BPM of a track is usually constant, but there are occurrences where the BPM may vary within the audio track.

A Downbeat is referred to the first beat of a measure.

Herein an audio track may refer to a song.

Scratching is referred to as a physical manipulation of a recorded sound, which is accomplished by a manual, back and forth playing of that recorded sound. For example, with a record player by holding the played record (disconnecting it from the spinning motor) and then moving the record back and forth against the needle at a specific point in the record, to make a special sound effect.

The specialty of a DJ is in selecting musical tracks to play to an audience and in "mixing" the musical tracks in a manner that may be pleasing to the listeners' ears. "Mixing" two tracks involves playing one track and then introducing the next track in such a manner that the transition to the next track is musically smooth. To the perception of the audience, one long musical stream is being played, not a collection of discrete tracks. Without mixing, a certain silence or jump in tempo may occur after each track.

Mixing is accomplished by playing the end of track A at the same time as track B starts. This overlap can create a new problem of mismatched beats, creating a clutter of two audio tracks, played simultaneously on two separate independent machines. The DJ attempts to make a smooth transition between the played tracks. The DJ matches the next track to the currently playing one in such a way that there may be no audible notice of a change of track. The audible sound is of a mix between the present track and the next one entering.

This matching between two different audio tracks is called mixing or beat mixing.

Normally, when the playing track, also referred to as track A or current track, is about to end, a new track, also known as track B or entering track, has to be introduced. Beat mixing is accomplished by matching the beats of the two audio tracks A and B. This matching is done by manipulating audio tracks by speeding them up or slowing them down, using a special control called a pitch controller, hence changing the audio track tempo of one or both the tracks until both tracks have the same tempo. In addition to matching the tempo, the timing of the beats of both tracks must be simultaneous, so that one track does not lag after the other. This is done by entering the downbeat of the entering track B at the time when a downbeat of the playing track A occurs.

One way of accomplishing beat mixing is by playing records using record turntables with a pitch controller. A pitch controller controls the revolutions per minute of the turntable, which changes the BPM of the played audio track. A DJ playing records can mix between two audio tracks by beat matching two audio tracks manually using the pitch controller on the turntable of the entering track. Mixing is initiated by entering the downbeat of the entering track at the downbeat of the playing track. Since both the new track entry and the beat matching process are manual, they are therefore imperfect and corrections are necessary so that the tracks will match one another exactly. These corrections are made by touching the turntable (clockwise to speed up or lightly touching to slow down) and further adjusting the pitch of the entering audio track, while both tracks are played. This sometimes leads to small audible glitches and other times to a complete out-of-beat mix.

In spite of these limitations, the record format is generally favored among DJ's due to the fact that the music's progress in time can be physically manipulated by the direct touch of a hand. This is done by either touching the record and speeding its spin compared to the motor speed, or slowing it down by touching the motor lightly.

CDs with mixing capabilities especially for DJs called CDJs have been introduced. The CDJ attempts to match the capabilities of turntable mixing, by offering a manual pitch controller and a rotational plate that can manipulate the played track in a way similar to touching the record as it is played.

The Digital Compact Disc (CD) is ROM (Read Only Memory) so that pinpointing inside a track is possible, meaning that there is a direct access to an exact point for each track. The CD media is different from the record media in that it is random access. This means that exact locations within the track can be marked and these locations can be used to skip between locations.

One way of using the random access capability of the CD media is know as a loop. A loop in a track is a repetition of a partial part of a track (track segment) initiating from one point A in the track and ends at another point B in the track. The loop must be made in such a way so that when a repetition is made and the track jumps back from point B to point A, the sound is smooth and there is no noticeable "glitch" to the audience. The choosing of points A and B is therefore done by marking a full number of measures, starting at the downbeat of a measure and ending just before the down-beat of the next measure.

Some of the advanced CDJs offer the ability to manually mark and play loops within a CD.

Creating loops within the audio track is not usually done during a live DJ performance because of the complexity of the process and lack of time when playing live. This is because in order to loop a certain part of the track, the loop must be perfectly made so that the exact number of measures is marked.

A DJ playing audio tracks can use the above mechanisms to play tracks and mix tracks in a variety of ways, but between playing analog records and using an advanced digital CDJ there is not much difference. In both media each track is played continuously from one point in the track to another. Moreover, in both machines, beat mixing must eventually be done manually. With analog records, the fact that a track is played from one point to another is not surprising. The fact is that the record media is not random access, meaning that it isn't possible to mark and reach any precise desired point in a track on a record at any given time while playing it.

The digital CD on the other hand is indeed random access but the CDJ playing machines attempt to try and imitate the record player rather than use the digital qualities of the digital media, by offering a rotating plate to imitate the touch of a record.

The DJ is therefore limited to the tracks that the DJ has, either original tracks or tracks prepared previously (this is a similar case to marking a loop with an advanced CDJ). The DJ's creativity during a live performance is based on the tracks played and the mixes made (or scratching techniques). The DJ cannot pick different parts of different tracks, loop them or assemble them in a live performance in order to better fit the music to the mood, fit the music to other tracks as well as to be more creative.

Although these described music playing methods let the DJ manipulate the music played to the audience, nevertheless all audio playing mechanisms suffer from a number of disadvantages:

The DJ cannot manipulate the contents of a currently played audio track at a moment's decision in a live situation, without planning and providing for that content manipulation in advance. The DJ can fade out the track and mix it with another but the DJ cannot skip a part of the track, return to a previous part of the track or loop a part of the track on the fly, without planning that manipulation it in advance.

During a mix of audio tracks, the DJ has to constantly monitor the playing tracks and apply corrections to the mix manually.

Before starting a mix, the DJ has to start the new audio track at the precise downbeat that fits with the starting beat of the currently played track. The DJ then needs to correct an inaccurate entry.

SUMMARY OF THE INVENTION

In accordance with the present invention, it is an object of the present invention to provide a method to create a variation of an audio track using audio building blocks. This track variation may be created during a live performance.

It is another object of the present invention to provide a method for initiating a precise beat-mix and to automatically maintain the beat mix, of two or more systems playing audio track building blocks.

The present invention makes use of the formatting of each audio track into a series of audio building blocks or audio segments. These audio building blocks may be prepared in advance in such a way so that some building blocks may be skipped, repeated or returned back to, while the track is being played.

In accordance with the present invention, formatting of audio tracks into audio building blocks may allow choosing of building blocks to play, and may allow the initiation and automatic maintaining of a beat mix of two systems simultaneously playing audio building blocks.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings, in which:

FIG. 4A–4D are schematic illustrations of an exemplary segment database in accordance with an embodiment of the present invention;

FIG. 8-I is a block diagram illustration of two synchronized audio track generators, in accordance with an embodiment of the present invention;

FIG. 8C is a modified version of audio track in FIG. 8B.

Figure 1:
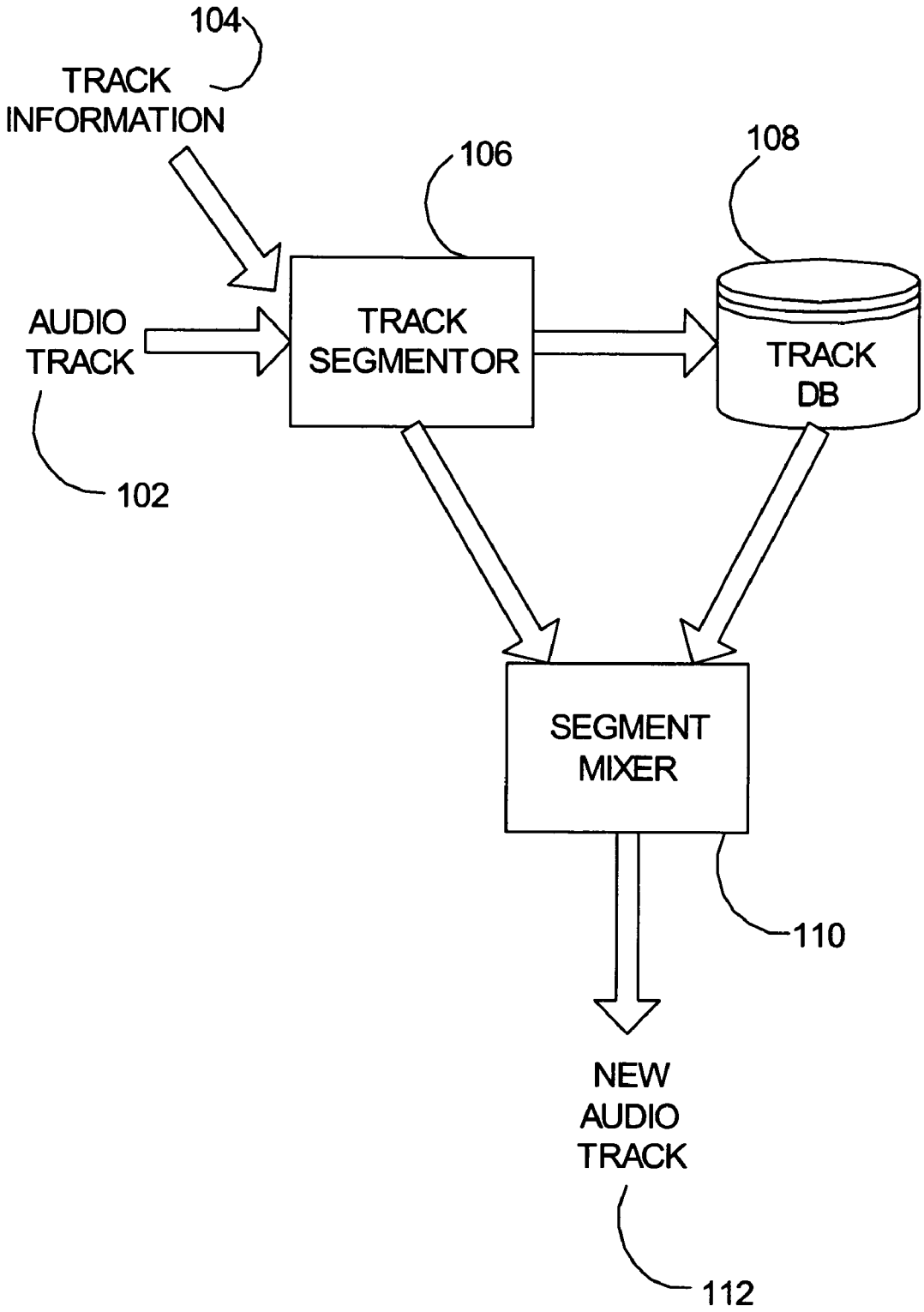
FIG. 1 is a block diagram illustration of an audio track generator, in accordance with an embodiment of the present invention.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

DETAILED DESCRIPTION OF THE INVENTION

In the following detailed description, numerous specific details are set forth in order to provide a thorough understanding of the invention. However, it will be understood by those of ordinary skill in the art that the present invention may be practiced without these specific details. In other instances, well-known methods, procedures, and components have not been described in detail so as not to obscure the present invention.

several advantages of the present invention are:

To provide a way to manipulate an audio track at any given moment, without the need for the DJ to plan in advance. This manipulation includes skipping a part of the audio track, returning to a previous part of the track and looping (repeating) a part of a track. This manipulation enables a DJ to actually create a new audio track that is made from parts of the original track and as a result, be more creative and original as well as fit the music better to the mood and audience.

To provide audio tracks mixing capability that automatically maintains the beat-mix of the playing tracks.

To provide a capability that corrects the DJ's mix starting point, by starting to play the new audio track at the precise moment that fits with the starting beat of the currently playing track.

In the description herein below, the term "Track Segment" refers to a part of an audio track. A track segment may also be referred to as segment or element.

In the description herein below, the term "Track Segmentor" refers to a machine, which may take as input an audio track, may receive optional track information and output track segments.

In the description herein below, the term "Track DB" refers to an information store, which may include track segment information and may include track header information.

In the description herein below, the term "Segment Mixer" refers to a machine, which may take in as input audio track and may take as input track segments and may take as input a track DB and outputs a new audio track.

Reference is now made to FIG. 1, a block diagram illustration of an audio track generator, in accordance with an embodiment of the present invention comprising a track segmentor 106, a track database 108, and a segment mixer 110. Track segmentor 106 may receive an audio track and/or an audio track segment (not shown) as input and may also receive track information 104 as input. Track segmentor 106 may output information to a track DB 108. Track DB 108 may include track segment information and may include track header information. Segment mixer 110 may receive audio track 102 and/or may receive track segments and may receive track DB 108 and may output a new audio track 112.

Figure 2:
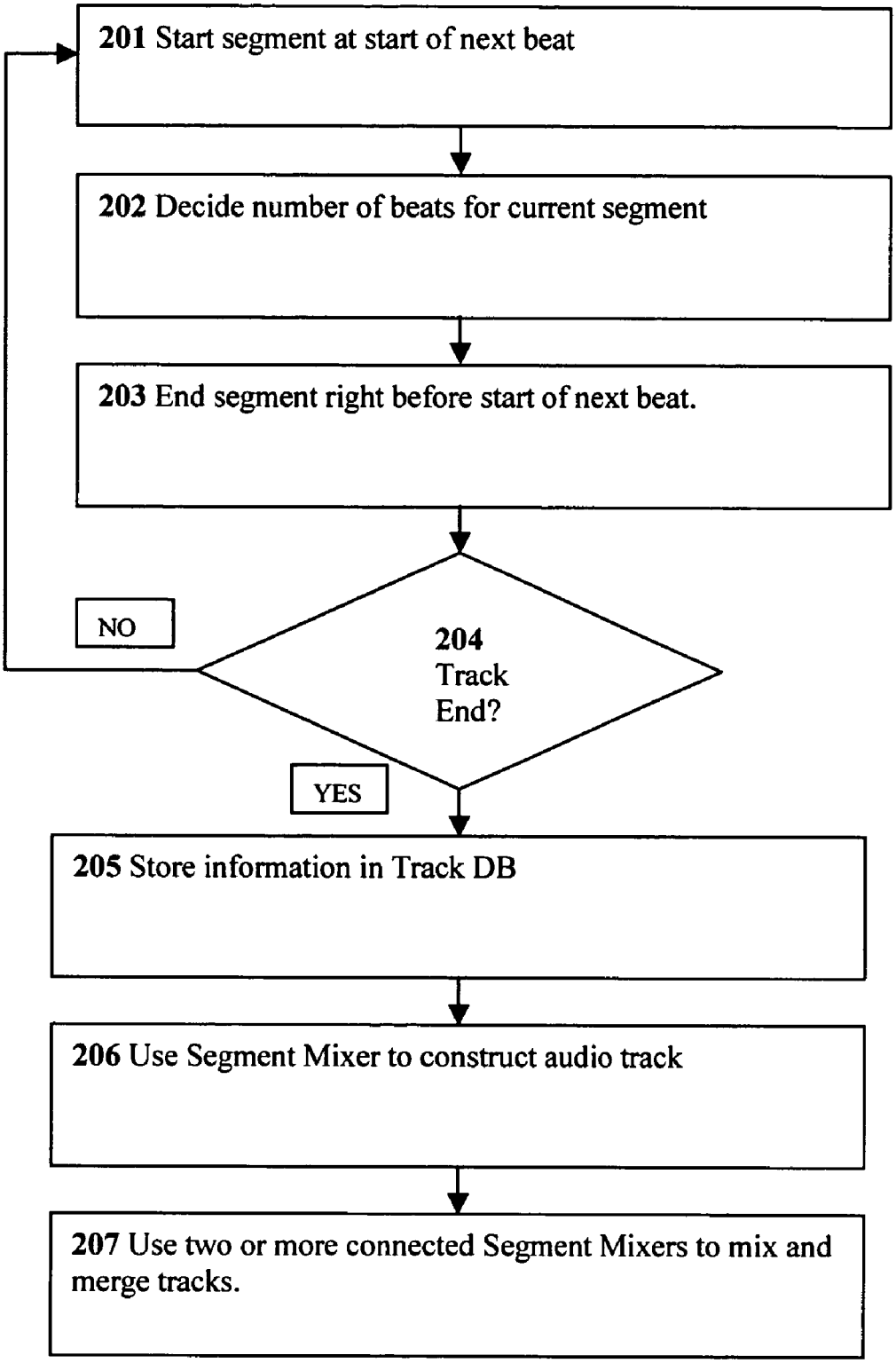
FIG. 2 is a schematic flowchart of generating an audio track, in accordance with an embodiment of the present invention.

Reference is now made to FIG. 2, a schematic flowchart of generating an audio track, in accordance with an embodiment of the present invention. Steps 201 to 204 may be performed by the track segmentor as described. In step 201, a segment start is marked. The segment starts at a start of a beat. In step 202 the number of beats to be included in the current segment are decided. This decision may be based on issues such as the time signature of the track (4 by 4 measures could be 4, 8, 16 for example), the makeup of track, the context of the segment in the track (a location where there is a break in a track, a location where vocals starts etc) and may be effected by the decision of the creator of the segments.

In step 203 the segment's end may be marked right before the start of the next beat. In step 204, a decision is made. If the track has not come to an end, step 201 follows. If the track has come to an end step 205 follows.

In step 205 segment information is stored in the track DB. Note this may also occur during segment generation, the invention is not so limited.

In step 206 a segment mixer is used to construct a new audio track.

In optional step 207 two or more connected segment mixers are connected to mix and merge tracks. This step may also include two or more audio track generators, which include a segment mixer.

Figure 3:
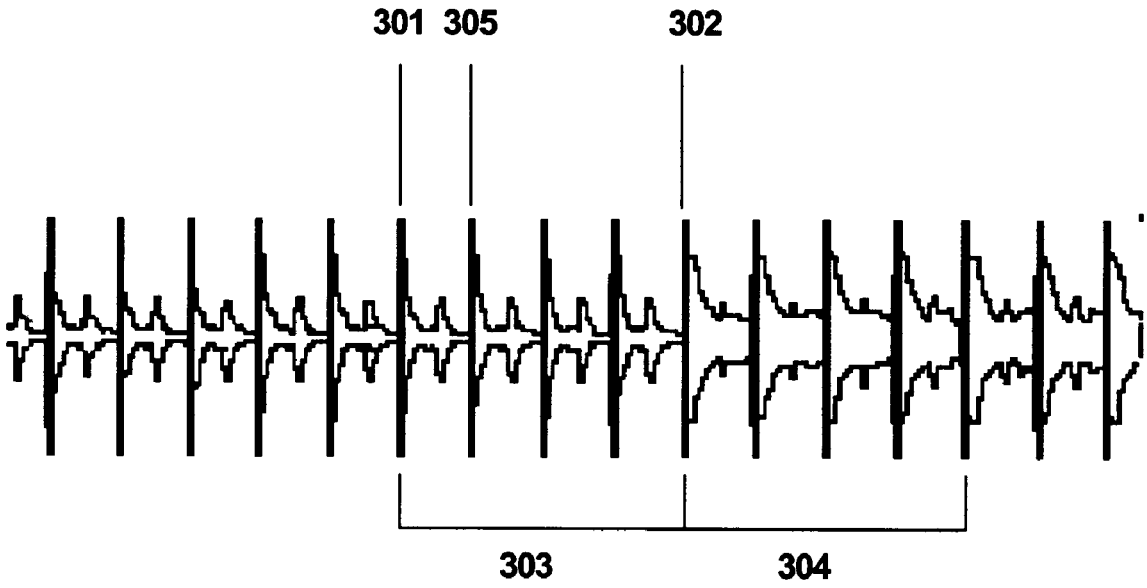
FIG. 3 is graphic representation of an exemplary portion of an audio track, showing the audio track's power as a function of time.

Reference is now made to FIG. 3, a graphic representation of an exemplary portion of an audio track, showing the audio track's power as a function of time. Two segments are shown in the figure as an example. The start point of each beat location is marked in the graph by a thin vertical line for each starting beat, such as in 301. A starting point of a single beat appears at 301. The single beat ends at 305. Two of the track's segments are marked in the figure, segment 303 and 304. Segment 303 starts at point 301. Therefore point 301 is a downbeat. Segment 303 ends at point 302, which is the end of the fourth beat from point 301. Part 304 immediately follows with 4 beats. Note that the power of segment 304 is higher than that of segment 303, which is one of the reasons for marking segment 304 independently of segment 303 which is an audible difference and desirable for looping separately/independently by the user.

In the example of FIG. 3, segments 303 and 304 are not overlapping. In other cases there may be an overlap or a gap in respect to the original track.

The deconstruction of audio track into segments may be made in such a way so that segments may be repeated several times (or looped), as well as be able to follow or precede some of the other segments. This may be done, by deconstructing the audio segments from a start of a beat until the end of a beat. This allows some segments to be played consecutively or repeatedly, so that the audience senses neither a pause, nor a tempo change.

There may be a need for segments that do not follow the above rule, but necessary to connect several of the above segments, so that the entire original track will be available to play consecutively. These segments will be referred to as "filler segments".

The deconstruction of an audio track into segments or elements, in the above manner may be done according to the following three guidelines: (1) A segment may be able to be repeated several times consecutively one after the other in a way that sounds natural to the listener's ear, such that no pause, beat change or major difference is noticed (2) a segment may be able to follow more than one other segment of the track in a way that sounds natural to the listener's ear, such that no pause, beat change or major difference is noticed and (3) a segment may be an independent or natural part of the track. Independent part means that the segment has a different aspect than preceding segments such as vocals start, a break in the track starts, so that the segment is independent of previous or following segments. In some embodiments Independent parts may also be split up to smaller segments.

In some embodiments, the division of tracks to segments may be made with the help of a computer program to suggest measure starting and ending points. There may be more than one way of splitting the track to segments. This follows from the essence of the music, which is by nature diverse and unpredictable, where two subjective ears can interpret a track differently. When there is more than one way of splitting a track into segments, the segment may be further broken smaller segments even if some parts are not independent. This is so that the track segments form building blocks so that later will be used to construct a new audio track. In some embodiments the deconstruction of a track into segments may be made in such a way so that most or all segments of the track are of a single beat duration.

Following the deconstruction of a track into the different segments, the segment information is listed in a track DB.

Figure 4A:
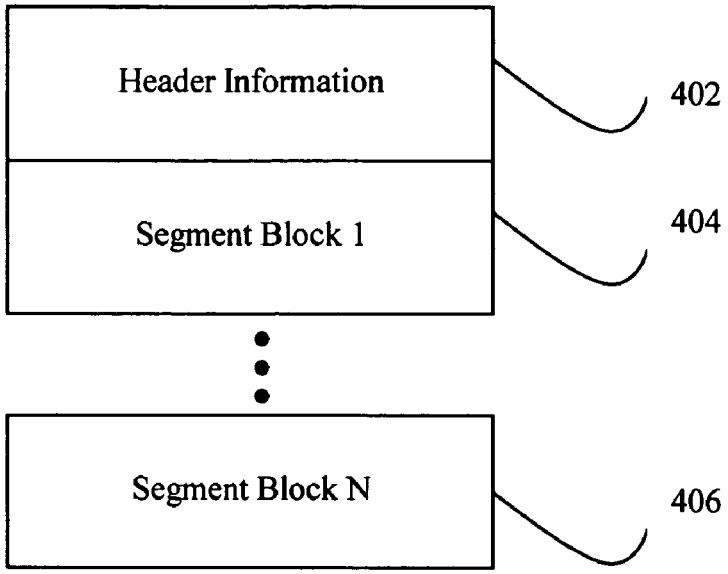

Reference is now made to FIGS. 4A–4D. FIGS. 4A–4D are exemplary non-limiting embodiments. FIG. 4A is an exemplary embodiment of a track database comprising header information 402, and N segment blocks. Shown herein are segment block 1 404 and segment block N 406. Header information may be empty or may include additional information.

Figure 4B:
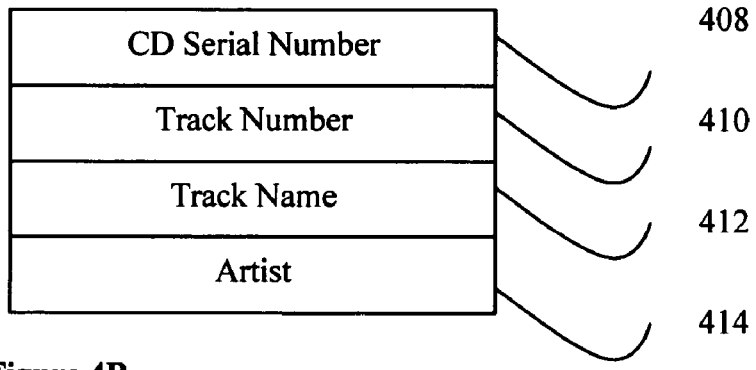

FIG. 4*b*, is an exemplary header information in a track comprising CD serial number 408, track number 410, track name 412, and artist 414.

Figure 4C:
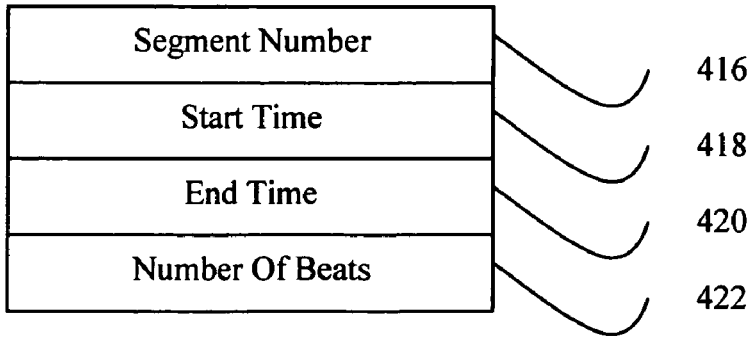

FIG. 4*c*, is an exemplary embodiment of segment information in a track database comprising segment number 416, start time 418, end time 420 and number of beats 422.

FIG. 4*d* is an exemplary embodiment for a track database comprising one track. In this non-limiting example, the CD serial number is 123232323. The track number is 1, the track name is Disco Queen by the 7 Monarcs. Each Segment entry includes the starting point and ending point of the segment. In FIG. 4D this information is provided in [minutes]:[seconds]:[parts of seconds] notation. For example, Segment 1 starts at 0.933 seconds after the beginning of the track and ends at 2.767 seconds after the beginning of the track. The track database in FIG. 4D also includes the number of beats included in each segment. For example, Part 1 includes 4 beats of the track.

The track database may comprise two types of information: a) it may comprise segment information and b) it may comprise segment Beat Per Minute or BPM. The BPM information may be extracted using the number of beats in each segment. The BPM may be calculated by taking the number of beats divided by the length of the segment in seconds times 60 seconds. For example, in FIG. 4D the BPM of segment 1 is calculated as follows: The duration of segment 1 is 1.834 seconds. The number of beats in segment 1 is 4. Therefore the BPM is 4/1.834*60=130.862 (rounded). This precise BPM information per segment may be important for audio track mixing as will be described in detail herein below with respect to FIG. 8.

In an embodiment the BPM may be listed for every segment instead of in addition to the number of beats per segment. The invention is not so limited.

In an embodiment, the BPM may be calculated without the additional information of number of beats or additional BPM, but only with the help of the exact segment information.

The track database may be added to the audio track in a number of ways. The track database segments information may be recorded on an audio CD by splitting the audio track into consecutive sub-tracks made of each of the segments. The invention is not so limited. Such a format allows the inclusion of an audio track along with its segmented information, as an integral part of the audio track. The track database may also be downloaded separately. In some embodiments the track database may reside in a separate external memory location such as a USB memory device or a SanDisk memory device. In some embodiments the track database may be entered manually into the segment mixer. In some embodiments the track database may reside on the same CD as the audio track as a mixed data/audio CD; In some embodiments the track database may not include the number of beats in each segment. In some embodiments track database may include starting points without ending points so that a segment's starting point is the previous segment's ending point. The segment marking points may be in seconds but also in other forms such as sample numbers.

In the description herein below, the term "Segment Controller" refers to a controller within a machine, to control the playing of a single track-segment.

Figure 5:
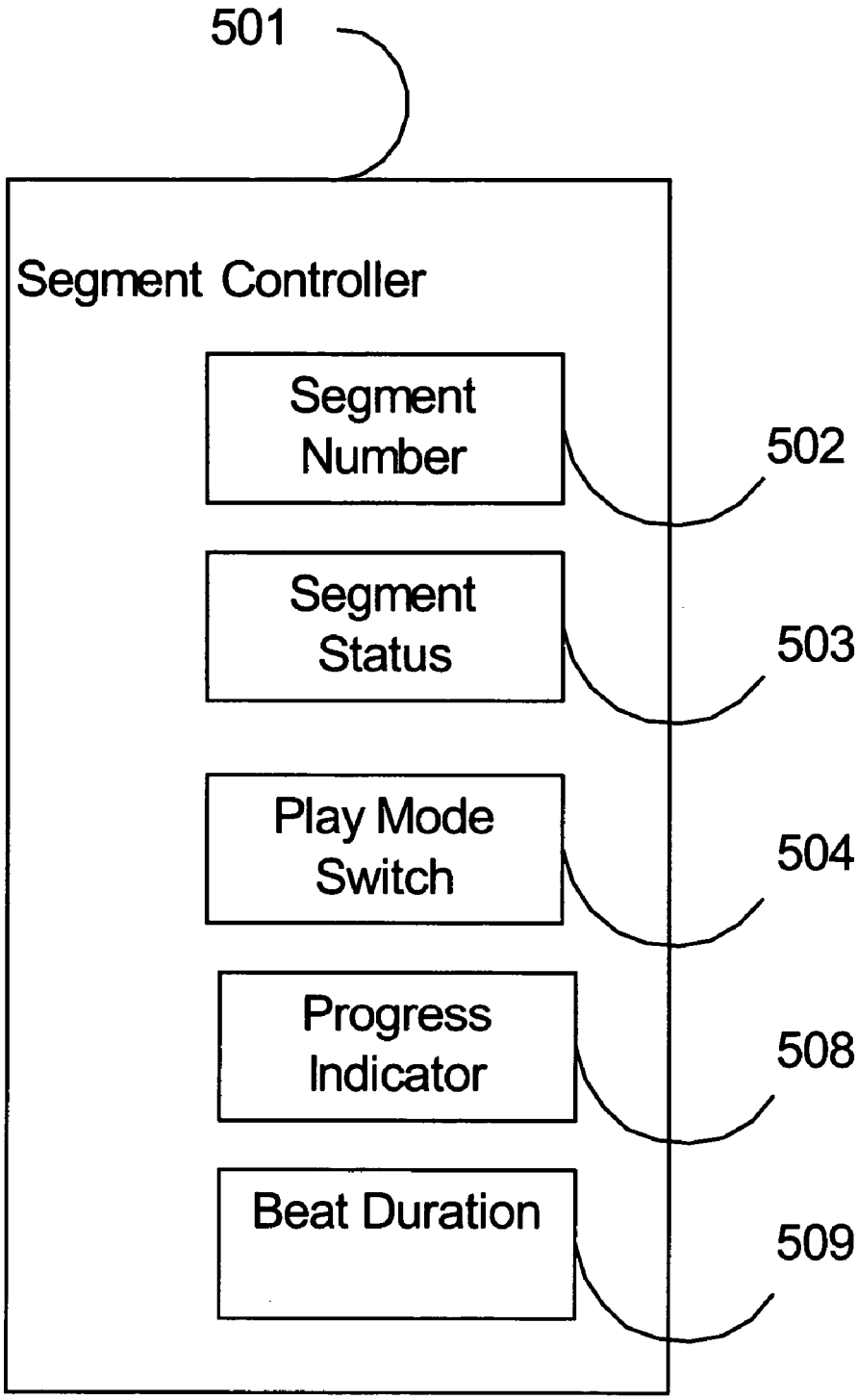
FIG. 5 is a schematic illustration of an exemplary embodiment of a segment controller.

Reference is now made to FIG. 5, a schematic illustration of an exemplary embodiment of a segment controller comprising a segment controller 501, segment number 502, segment status 503, a play mode switch 504, a progress indicator 508 and beat duration 509. The Play mode switch 504 may allow the DJ to control the current play mode of a single segment. In an embodiment a play mode switch may include the following exemplary settings: (1) off (2) play (3) loop and (4) return back to. In play mode "off" the segment may be skipped and not played. In play mode "play" the segment may play once. In play mode "loop" the segment may be repeated N times. In play mode "return back to X" the segment is returned to segment X after it has been played. In some embodiment only switch play mode 504 exists in the segment controller. In some embodiments switch play mode 504 is included with other switches, displays and others. The invention is not so limited. In FIG. 5, the segment number 502 includes the current number of the segment within the audio track. Segment status 503 states whether the segment has been reached. Progress indicator 508 indicates the location within the current segment, when the segment plays. Beat duration 509 indicates the length of the segment in beats.

In the description herein below, the term "Segment Mixer" refers to a machine, which may take in as input audio track and may take as input track segments and may take as input a track DB and may output a new audio track.

Figure 6:
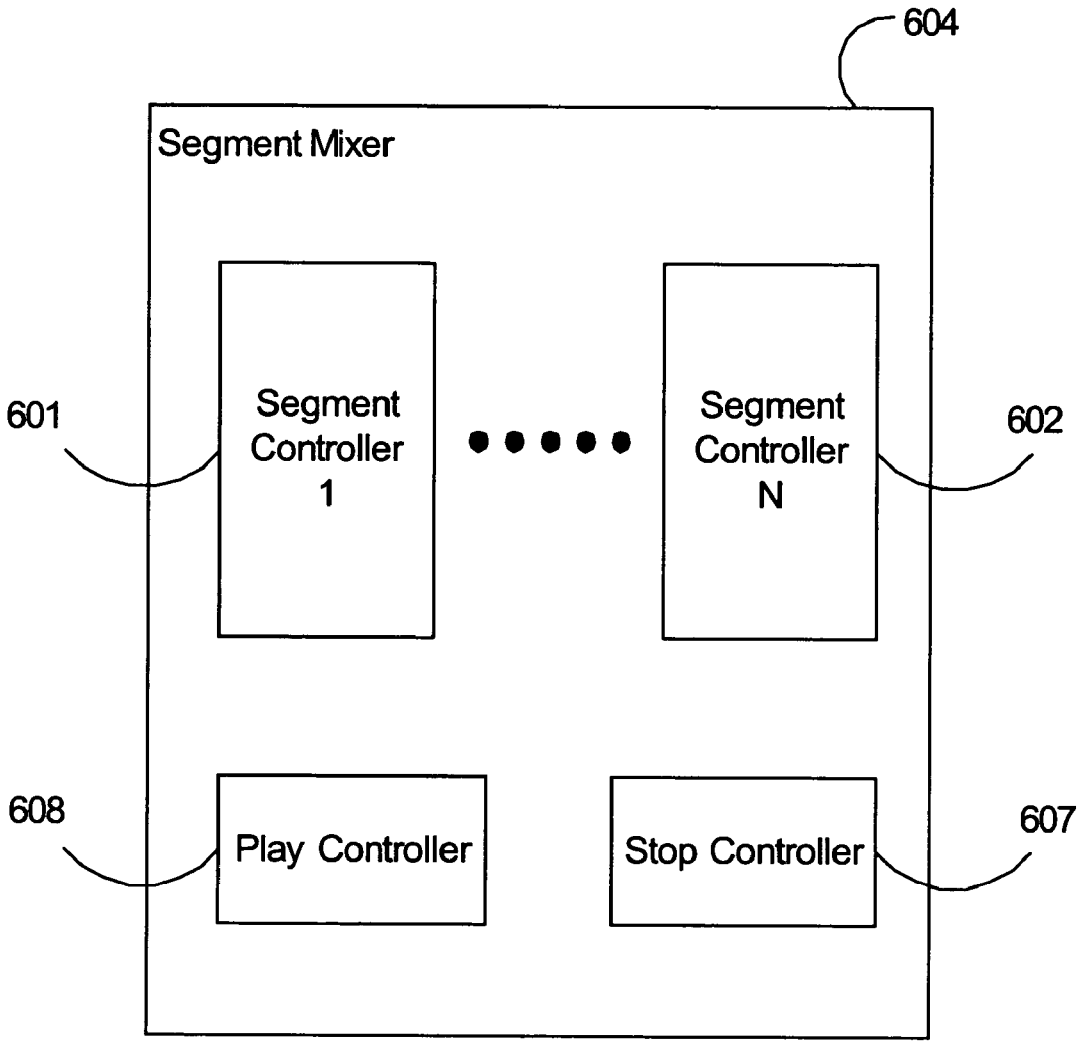
FIG. 6 is a schematic illustration of an exemplary embodiment of a segment mixer.

Reference is now made to FIG. 6, a schematic illustration of an exemplary embodiment of a segment mixer 604 comprising N segment controllers starting at segment controller 1 (herein labeled 601) to segment controller N (herein labeled 602), a play controller 608 and a stop controller 607. The segment controllers 1 (601) through N (602), each may represent a track segment. Each segment controller may be used to control how the represented segment will be played, according to the play mode switch 504 of FIG. 5.

Figure 7A:
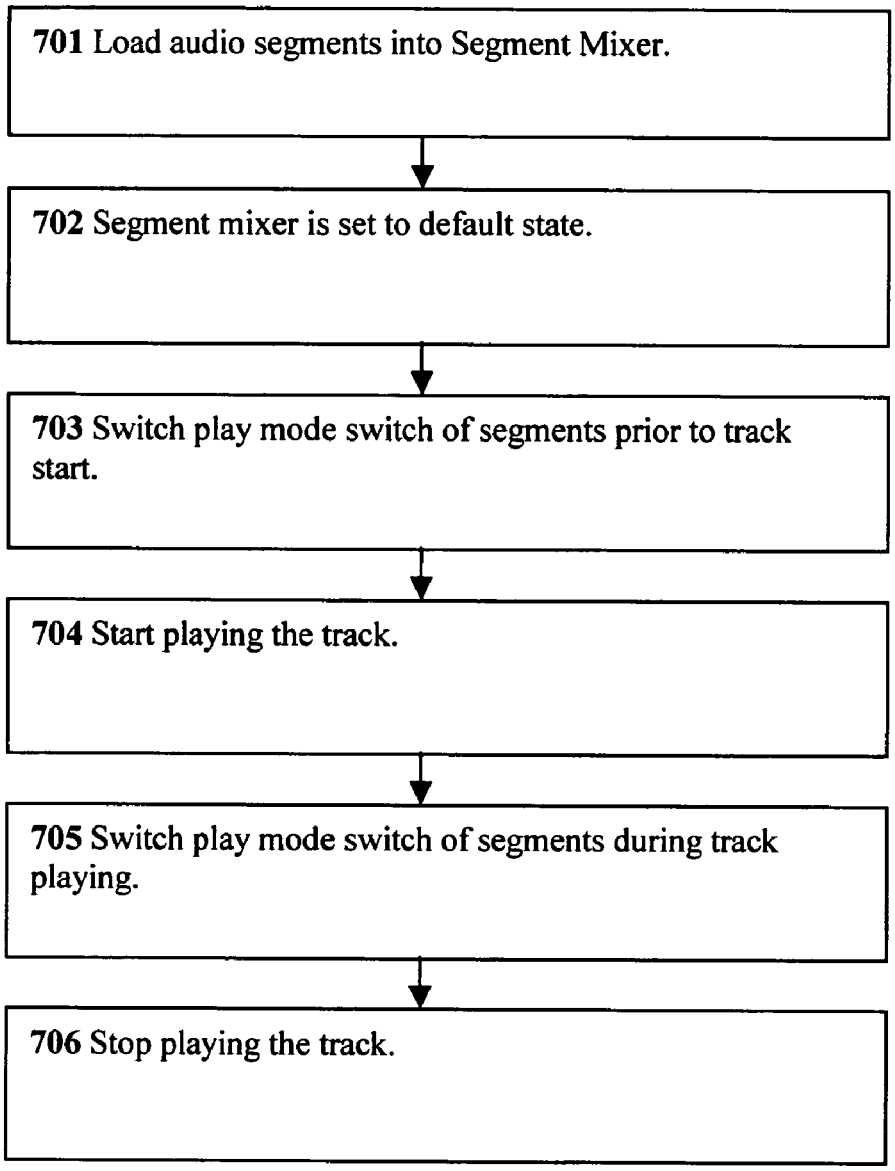
FIG. 7A is a schematic flowchart of using a segment mixer, in accordance with an embodiment of the present invention

Reference is now made to FIG. 7A, a schematic flowchart of using a segment mixer, in accordance with an embodiment of the present invention. In steps 701 the track segments may be loaded into the segment mixer. In step 702, segment mixer may be set to default settings, for example, by setting play mode switch 504 of each of segment controller 1 (601) to segment controller N (602) to some default setting, for example "play". In step 703 a DJ may set play mode switch 504 of each of segment controller 1 601 to segment controller N 602 to some other position, for example "off", prior to starting to play the track. In step 704 a DJ may start playing by pressing the play controller 608. In step 705 a DJ may switch play mode switch 504 of any of segment controller 1 601 to segment controller N 602 to other positions during track playing. As a result, track segments may be played in any order and each may be played zero or any number of times. In some embodiments segments may be played simultaneously. In step 706 a DJ stops playing by pressing the stop controller 607.

The audio track played as a result of using a segment mixer may be a new track formed of existing track segments according to segment controller settings controlled by a DJ.

The described controls above for controlling track segments are made for different reasons. Here are some examples. (1) If a DJ sees that certain segments of the track had a strong impact on the audience and wishes to repeat those segments. The DJ can return to a segment by using the controls as described above. (2) A DJ may wish to skip some segments of the track, which at the moment do not fit the mood of the audience. This can be helpful to shorten a track that does not fit well, in a graceful manner (instead of cutting it). (3) A DJ may wish to loop a certain segment in order to que the track (get it ready prior to playing to the audience), match it with the currently playing track, as well as play bits of that loop with the currently playing track. (4) A DJ may not wish the currently playing track to end. Therefore a DJ may set a segment to repeat so that the current track does not end unexpectedly. In addition, it is possible to enter the next track during that played loop.

Figure 7B:
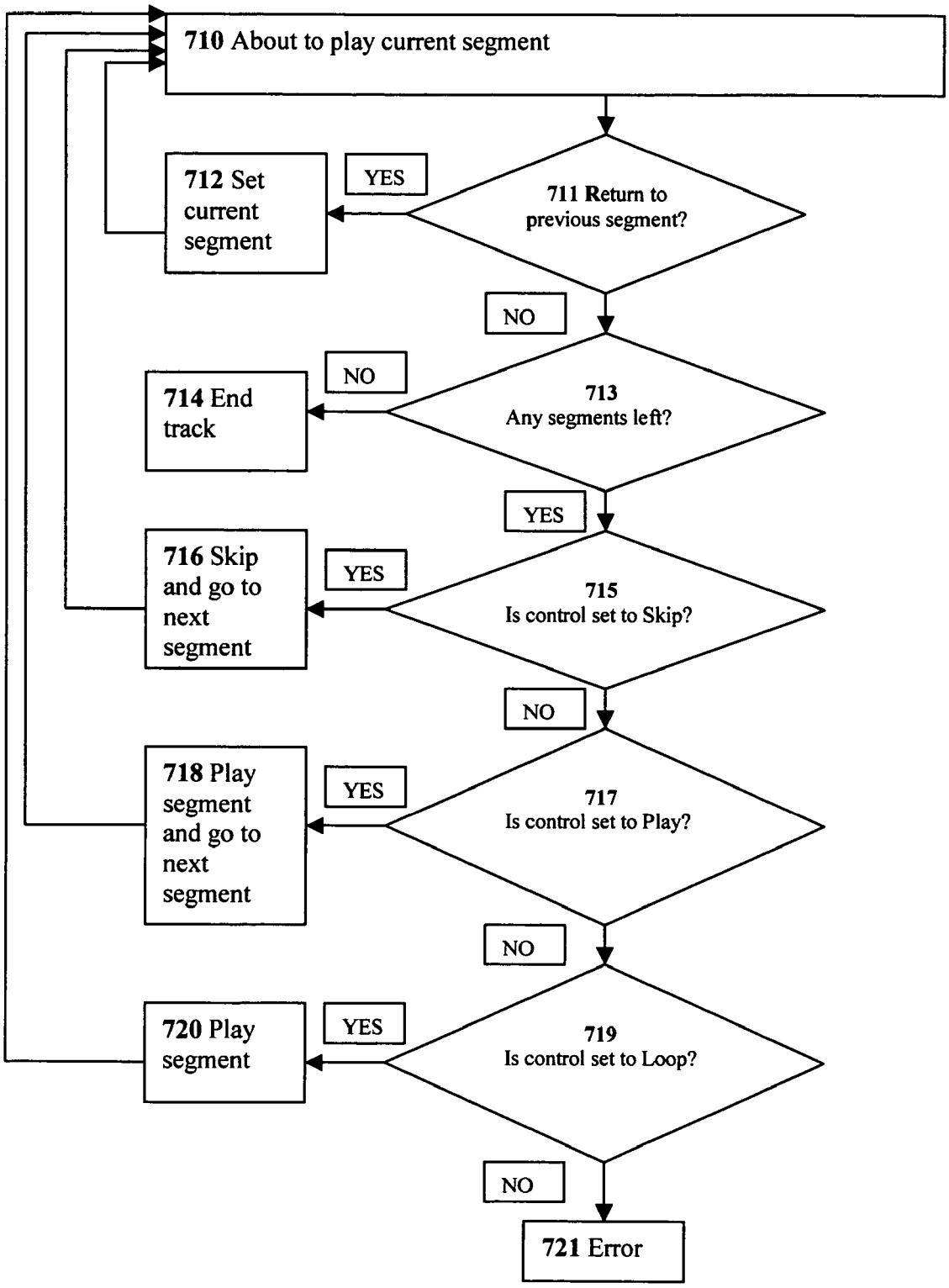
FIG. 7B is a schematic flowchart of the logic which may be used by a segment mixer, in accordance with an embodiment of the present invention.

Reference is now made to FIG. 7B, a schematic flowchart of the logic which may be used by a segment mixer, in accordance with an embodiment of the present invention.

In step 710 a segment mixer may be prepared to play a current segment.

In step 711 a check may be made, whether segment previous to the current segment is set to return to. If so, the previous segment may be returned to, for example, by setting it to be the current segment, step 712, and returning to step 710. If no previous segment should be returned to, step 713 follows.

In step 713 a check is conducted, whether any segment is left to play. If not, the track ends playing 714. If so, step 715 follows.

In step 715 a check is conducted, whether the current segment controller's play mode switch is set to "skip" or "off". If so, segment is skipped and the following segment is set as the current segment 716, and returning to step 710. If not, step 717 follows.

In step 717 a check is conducted, whether the current segment controller's play mode switch is set to "play". If so, segment is played once, and the following segment is set as the current segment 718, and returning to step 710. If not, step 719 follows.

In step 719 a check is conducted, whether the current segment controller's play mode switch is set to "loop" or "repeat". If so, segment is played once, (the segment just played is left set as the current segment) 720, and returning to step 710. If not, step 721 follows.

Step 721 is not a valid option in this exemplary embodiment. In some embodiment there could be additional decisions implemented to continue this logic flowchart. In some embodiments the number of times to loop or repeat a segment may be set.

In some embodiments adjacent segments that are switched to loop or repeat are looped together. For example, if segment 1 is set to loop, segment 2 is set to loop and segment 3 is set to play, then segment 1 will play, then segment 2 will play and then segment 1 will continue again, thereby creating a longer loop of all the consecutive parts marked in Loop position.

In the description herein below, the term "master audio track generator" refers to an audio track generator of FIG. 1 where this machine is determined to set the pace or beat to other devices.

In the description herein below, the term "slave audio track generator" refers to an audio track generator of FIG. 1 where this machine is determined to receive the pace or beat from another device, and set its pace according to it.

Reference is now made to FIG. 8-I, a block diagram illustration of two synchronized audio track generators, in accordance with an embodiment of the present invention comprising a master audio track generator 850, a slave audio track generator 852 and a means of coupling said audio track generators 851. master audio track generator plays normally and outputs information such as beat occurrences and beat durations to the slave audio track generator 852 through a means of coupling the audio track generators. The slave audio track generator 852 receives the synchronization information and plays each of its beats according to the synchronization information received from the master audio track generator 850. As a result, both audio track generators play audio segments in a beat-synchronized manner.

In some embodiment, the communication between audio track generators comprises of (a) Beat triggering for every start of beat and (b) Beat duration, or how long the current beat is going to be. This information is available due to the following (1) each of the segments starts at a beat start, (2) the lengths of each of the segments are known in advance and (3) the number of beats included within the segments is knows. The master audio track generators can calculate the length of the beat that is going to be played and communicate beat trigger and beat duration to another device. The slave audio track generator can manipulate the duration of its segment's beat by either stretching or compressing the duration, for example by pitch control.

In addition to matching the beat duration between two audio track generators, the initial playing of a slave audio track generator is matched to the master audio track generator as follows. When the DJ chooses to start playing the slave track, and presses "Play", the slave track first segment is matched to the nearest beat of the currently playing master track.

Figure 8A:
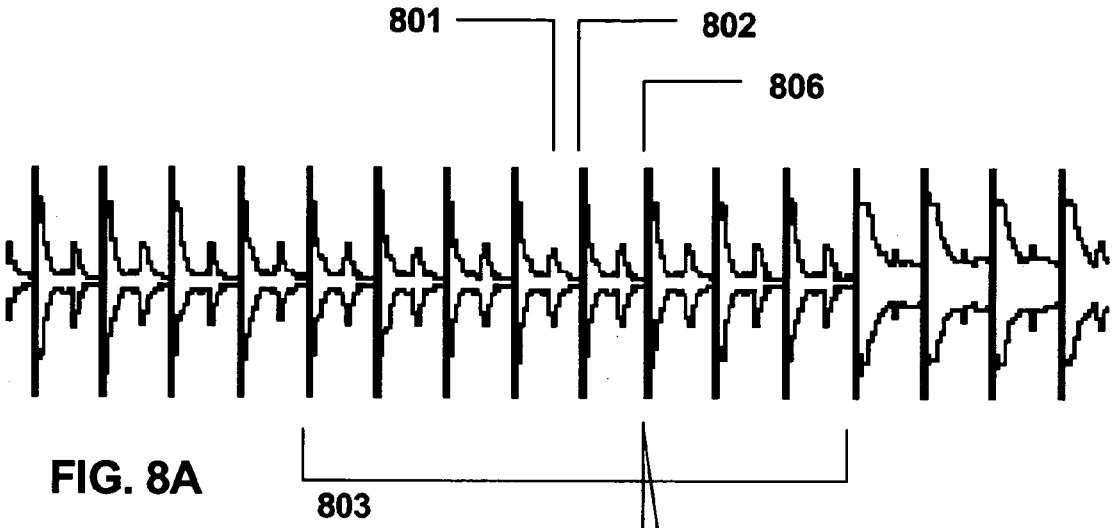
FIGS. 8A, 8B, 8C is a graphic representation of exemplary portions of two audio tracks 8A and 8B to be beat-matched, showing the audio track's power as a function of time.
Figure 8B:
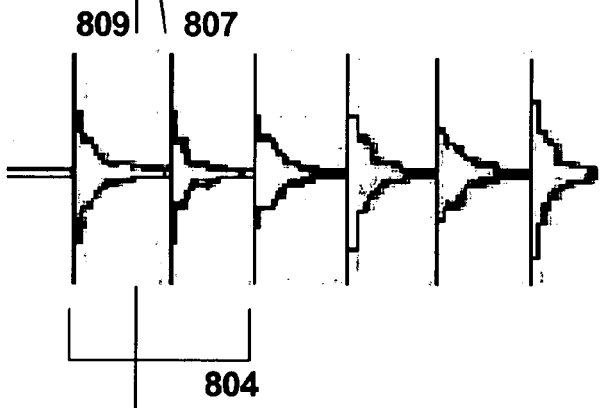
Figure 8C:
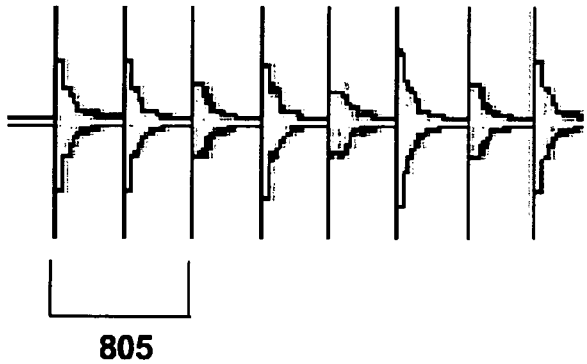

Reference is now made to FIGS. 8*a*, 8*b* and 8*c*. These figures are a graphic representation of exemplary portions of two audio tracks 8A and 8B to be beat-matched, showing the audio track's power as a function of time. FIG. 8C is a modified version of audio track in FIG. 8B. The three figures are placed on the same time scale. FIG. 8A shows an exemplary portion of the currently playing audio track in a master audio track generator 850 (denoted by "master track"). The current segment of FIG. 8A now playing is denoted as segment 803. The current beat being played is the fourth beat of segment 803. FIG. 8B shows another track (denoted as "slave track") to be started playing simultaneously with the track in FIG. 8A. The location where a DJ chose to start playing the slave track of FIG. 8B is in point of time 801. The actual time location where the slave audio track generator 852 starts to play the slave track is at point 802, which is the nearest starting beat location to point 801.

The first part of the slave track in FIG. 8B 804 includes 2 beats. The end of the first beat of the slave track of FIG. 8B 807, occurs past the next beat of the master track of FIG. 8A 806. FIG. 8C contains the slave track of FIG. 8B with its duration modified (a modification such as pitch change) to match the duration of the next beat of the master track of FIG. 8A. The duration of a beat is calculated by segment length divided by the number of beats within that segment. The modified slave track's first beat ends at point 808 in FIG. 8C, which coincides with the ending of the next beat of the master track of FIG. 8A at point 806. In this manner, each beat of the slave track is modified to match the length of the master's currently playing beat;

As a result of the above, the beat matching is initialized and kept throughout the mix time automatically. This is made possible due to the fact that the segments have been made in such a way so that they are sliced from beat start to beat end, and because of the fact that the number of beats in each segment known. This is ability is not available in today's CDJ equipment where the DJ needs to apply corrections and continuously monitor a mix.

In some embodiments if the start request 801 occurs after the beginning of the beat 802, it is possible to start playing the slave track immediately and calculate the duration that needs to be shortened from the segment's beginning in order to fit that beat with the master track. Doing so is favorable when the start request 801 occurs before the middle of the currently playing measure of the master's segment.

Although a beat match of a "master" track and a "slave" track has been described, the present invention is not limited to the beat matching of two tracks.

According to some embodiments, it is possible to match more than two audio tracks together by denoting additional audio track generators as "slave" machines. This way each additional track that is played begins at the nearest beat of the master track and its beat duration is matched to the duration of the next master's beat length, as described above, in order to beat-match the master's playing track.

In some embodiments, the communication output channel of the master audio track generator 851, which may output beat triggering and beat duration, may be used for additional or other purposes to synchronized beat mixing. Such usage may be to output the beat (or clock) of the currently playing "master" track out to an external appliance that will receive the exact beat of the audio being played. Such appliances may be for example, lighting system or flickers. Such appliances may be a VJ station, which can now be synchronized with the playing audio in the club. Other external appliance may be a live electronic musical instrument that can be synchronized to the currently played track.

In some embodiments, it may be possible to change the BPM of the two or more audio track generators during a mix. This is possible because by changing the BPM of the master machine, the slave machine can now synchronize to the next measure in the same manner as it did before. In some embodiments, the BPM change starts to occur from the next beat following BPM request, so that synchronization is easier to be matched.

It may be appreciated by those skilled in the art of the present invention that the following advantages exist in this invention, over the existing mechanisms:

(a) With an audio track generator it is possible to manipulate the currently played audio track at a live situation to create a variation of an audio track and to better fit the music to the audience. This manipulation includes skipping a part of the audio track, returning to a previous part of the track and looping (repeating) a part of a track.

(b) With an audio track generator it is possible to provide audio tracks mixing capability that automatically maintains the beat-mix of the playing tracks.

(c) An audio track generator provides a capability that corrects the starting point of the new played track, by starting to play the new audio track at the precise moment that fits with the starting beat of the currently playing track.

(d) With an audio track generator it is possible to have the played track, by default, loop at its end so that the DJ may not find the played track has suddenly ended.

(e) Connected audio track generators maintain an automatic beat mix of the playing track segments in each of the audio track generators.

(f) An audio track generator's knowledge of the location and duration of the beats of the currently played audio, may be used to synchronize other appliances to the audio played, such as visual appliances or musical appliances.

(g) With an audio track generator, it is possible to change the BPM of the audio played during a mix of two or more tracks.

Additional Embodiments

Figure 9:
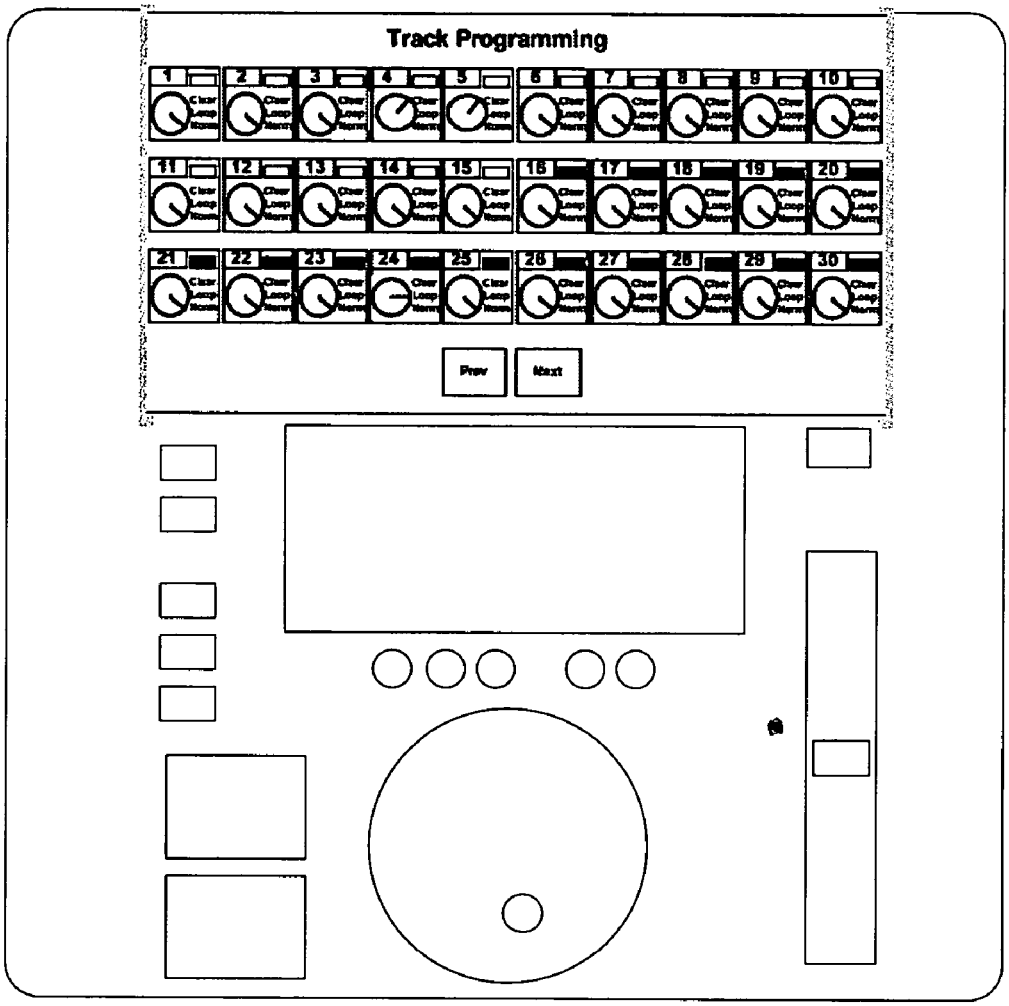
FIG. 9 is a schematic illustration of an exemplary embodiment of an audio track generator included with a CDJ.

In some embodiments an audio track generator may be included within a CDJ as is shown in FIG. 9. In some embodiments an audio track generator may be included without other functions. In some embodiments an audio track generator is included with other additional functions. In some embodiments the audio track generator is a computer program that implements an audio track generator. In some embodiments, more than one audio track generator can run on a single computer.

According to some embodiments, segment controllers from several tracks may be used to create a new track.

In some embodiments, an audio track generator can have a time-shift function, in case a small shift in time is necessary so the mix will sound better.

In some embodiments, an audio track generator can have a function that skips a beat or moves back a beat, immediately following the end of the current beat being played. This is useful where a DJ is already within the mix and only then notices that the mixed track is a beat or more ahead or behind.

Although the dynamic control of the order of segments to be played was discussed above, in some embodiments a static audio track generator can be made to sequentially play audio segments in a given order. In some embodiments it is possible to create a play list of several audio tracks that include beat-mixing starting and ending points for each track.

In some embodiments, a music Juke-Box can use the an static audio track generator to automatically mix the end of a playing of a song and the beginning of the next song simultaneously. It is also possible to program a play-list to beat-mix each 2 tracks from a certain point to a certain point.

It will be appreciated that, for simplicity and clarity of illustration, elements shown in the figures have not necessarily been drawn to scale. For example, the dimensions of some of the elements may be exaggerated relative to other elements for clarity. Further, where considered appropriate, reference numerals may be repeated among the figures to indicate corresponding or analogous elements.

Conclusion, Ramifications and Scope

Accordingly, the reader will see that the audio track generator invention's operation may provide a way to manipulate the currently played audio track at any given moment in a live situation, even without the need to plan in advance.

An audio track generator provides audio tracks mixing capability that may correct the initiation of a beat-mix and may automatically maintain the beat-mix of two playing tracks. Furthermore, an audio track generator has the additional advantages in that:

It may allow a track to never end before a DJ wants it to, so that one never encounters a "beat-drop" or silence in the middle of a music playing session.

It may allow initiation and maintaining a mix of more than two tracks playing simultaneously.

It may allow outputting the beat of the played audio to synchronize other appliances.

It may allow changing the BPM of the audio played during a mix of two or more tracks.

It may allow moving a beat forward or backward during the playing of a track.

Although the description above contains many specifications, these should not be constructed as limiting the scope of the invention but as merely providing illustrations of some exemplary embodiments of this invention.

For example, the slicing of tracks into segments may be done in other ways to the one explained here, not all segments have to include a whole number of beats, some or all segments may include only a single beat, an audio track generator may include only a some of the functionality of the system described here, and the ways of controlling the segment skipping, looping and playing may be done in a different manners to the one explained here. The track database is only an example of how the segment information is kept. It may be presented in other ways or deducted in other ways and presented here for explaining purposes. The usage of the audio track generator can be done in other ways as explained here. The audio track generator does not need to have a beat matching option, or it can have a different beat matching option than described here, either based on the beat information or not based on beat information. An audio track generator may include only the audio track generator controls or be included within another machine such as a CDJ. Such a machine can have audio track generator functions as well as other CDJ options dependent or independent of the audio track generator options, and so forth.

While certain features of the invention have been illustrated and described herein, many modifications, substitutions, changes, and equivalents will now occur to those of ordinary skill in the art. It is, therefore, to be understood that the appended claims are intended to cover all such modifications and changes as fall within the true spirit of the invention.

What is claimed is:

1. A system comprising:

a track segmentor for segmenting a track by splitting said track into track segments cut from said track each of said track segments containing time portion of said track;

a track database comprising a plurality of track segments generated by said track segmentor; and a segment player that sequentially plays a plurality of track segments one segment at a time consecutively with no gaps and no overlaps allowing to dynamically change order of played track segments during play of said plurality track segments to create a track from said plurality of track segments during play of said plurality track segments.

2. The system of claim 1 wherein said track database comprises at least one sequence of a plurality of track segments.

3. The system of claim 2 comprising means for loading said segment player with a sequence of said at least one sequence of a plurality of track segments.

4. The track segments of claim 1 wherein at least one of said track segments begins at the start of a beat, lasts a full number of beats and ends before the start of a next beat, whereby said track segments form building blocks enabling the creation of a track.

5. A method for consecutively playing track segments one immediately following the other during play comprising:

playing track segment according to preset instructions;

checking preset instructions for next track segment to play immediately following current playing track segment during play of said playing track segment;

modifying preset instructions for a track segment during play of said playing track segment;

changing track segment play order dynamically according to modified instructions during play of said playing track segment.

6. The method of claim 5 wherein said consecutively playing track segments are played one after the other with no gaps and no overlaps.

7. The method of claim 5 wherein an initial play order of said track segments is taken from a track database.

8. The method of claim 5 comprising means for playing track.segments at the same BPM rate.

9. The track segments of claim 5, wherein at least one of said track segments begins at the stavt of a start of beat, lasts a full number of beats and ends before the start of a next beat, whereby said track segments form building blocks enablitig the creation of a track.

10. The track segments of claim 9, wherein each said segment is marked by a number denoting the number of beats it contains, whereby said track segments form building blocks enabling the creation of a track and the beat mixing of track segmens.

11. A method for representing a track, comprising:

a plurality of track segments each consisting of a segment split from said represented track each containing time portion of said represented track;

a default order of said track segments to be played consecutively one immediately following the other;

whereby said track segments form building blocks enabling the creation of a track by placing said track segments in various orders consecutively and said default order of said track segments forms a default track.

12. The track segments of claim 11 wherein at least one of said track segments begins at the start of beat, lasts a full number of beats and ends before the start of a next beat, whereby said track segments form building blocks enabling the creation of a track.

13. The track segments of claim 12, wherein each said track segments is marked by a number denoting the number of beats it contains, whereby said track segments form building blocks enabling the creation of a track and the beat mixing of track segments.

14. The track segments of claim 11 wherein said track segments are stored in a track database stored on a separate media than said represented track.

15. The track segments of claim 11 wherein said track segments are stored in a track database stored on the same media of said represented track.

16. A system comprising:

a track database comprising data of a plurality of track segments;

a master segment player to sequentially play a plurality of track segments one segment at a time to create a master track from said data during play allowing to dynamically change order of played track segments during play of said plurality track segments;

at least one slave segment player each to sequentially play a plurality of track segments one segment at a time to create a slave track from said data during play allowing to dynamically change order of played track segments during play of said plurality track segments; and a coupling means to combine said master track and said at least one slave track during play of said master track and said at least one slave track.

17. The system of claim 16 wherein at least one track segment played by said at least one slave segment player has a different BPM rate to a track segment simultaneously played by said master segment player.

18. The system of claim 17, wherein at least one said slave segment player plays at least two track segments having different BPM rates.

19. The system of claim 17, wherein said slave segment player initiates playing in accordance to closest beat start of said master segment player automatically following a start of play request during play of said master segment player.

20. The system of claim 17, wherein said master segment player beat information is exported to at least one external device.

21. The external device of claim 20, wherein said external device is Video equipment (VJ) whereby the video projected synchronizes with the music beat.

22. The external device of claim 20, wherein said external device is Lighting equipment whereby the lighting effects synchronizes with the music beat.

* * * * *